US005993104A

United States Patent [19]

Marcotullio et al.

[11] Patent Number: 5,993,104

[45] **Date of Patent: *Nov. 30, 1999**

[54] NON-LETHAL, RAPIDLY DEPLOYED, VEHICLE IMMOBILIZER SYSTEM

[75] Inventors: John P. Marcotullio, Carbondale, Ill.; David A. Edmonds, Palm Harbor, Fla.; Randel L. Hoskins, Bothel, Wash.

[73] Assignee: Primex Technologies, Inc., Redmond, Wash.

[ * ] Notice: This patent is subject to a terminal disclaimer.

[21] Appl. No.: 09/008,978

[22] Filed: Jan. 20, 1998

Related U.S. Application Data

[62] Division of application No. 08/672,148, Jun. 27, 1996, Pat. No. 5,829,912.

[51] Int. Cl.[6] ..... E01F 13/04

[52] U.S. Cl. ..... 404/6; 49/9; 49/34; 49/131

[58] Field of Search ..... 404/6, 9; 49/9, 49/34, 131; 256/1, 13.1

[56] References Cited

U.S. PATENT DOCUMENTS

| | | | |
|---|---|---|---|
| 2,237,106 | 4/1941 | Minert . | |
| 2,465,936 | 3/1949 | Schultz | 256/13.1 X |
| 2,663,103 | 12/1953 | Ellison . | |
| 2,675,197 | 4/1954 | Hospers | 49/9 |
| 4,318,079 | 3/1982 | Dickinson | 404/6 X |
| 4,333,268 | 6/1982 | Dumbeck . | |
| 4,354,771 | 10/1982 | Dickinson | 404/6 |
| 4,480,405 | 11/1984 | Ferguson . | |
| 4,576,507 | 3/1986 | Terio . | |
| 4,759,655 | 7/1988 | Gorlov . | |
| 4,780,020 | 10/1988 | Terio . | |
| 4,824,282 | 4/1989 | Waldecker . | |
| 4,922,655 | 5/1990 | Seal | 49/131 |
| 4,923,327 | 5/1990 | Gorlov . | |
| 5,026,203 | 6/1991 | Gorlov . | |
| 5,245,787 | 9/1993 | Swenson et al. | 49/131 X |
| 5,310,277 | 5/1994 | Uotila . | |
| 5,394,927 | 3/1995 | Huebner | 256/1 |
| 5,498,100 | 3/1996 | Guernsey | 404/6 |
| 5,525,875 | 6/1996 | Thommen | 256/13.1 X |
| 5,560,733 | 10/1996 | Dickinson | 49/49 X |
| 5,624,203 | 4/1997 | Jackson et al. | 404/6 |
| 5,762,443 | 6/1998 | Gelfand et al. | 404/6 |
| 5,823,705 | 10/1998 | Jackson et al. | 404/6 |
| 5,829,912 | 11/1998 | Marcotullio et al. | 404/6 |

OTHER PUBLICATIONS

Military Specification No. MIL–T–81521A(A5) Tape, Textile, Nylon, Landbased Arresting Gear, 7 inch, Apr. 24, 1969.
Military Specification No. MIL–W–4088K 83, Jan. 1995.
Military Specification No. MIL–C87129A 40, Jan. 1995.
Roadway Safety Service, Inc. produce literature entitled: *The Dragnet Vehicle Arresting System* (1992).

*Primary Examiner*—James A. Lisehora
*Attorney, Agent, or Firm*—Wiggin & Dana; Gregory S. Rosenblatt

[57] ABSTRACT

There is disclosed a transportable device and associated method for impeding the motion of a land vehicle travelling along a pathway on a terrain surface. First and second supports are positioned at first and second sides of the pathway, respectively, each capable of being actuated from a compressed condition to an extended condition. A propulsion system is effective to actuate the supports. A barrier extends between the supports at a mean first height that is effective to permit passage of a vehicle when the supports are compressed and supported by each support at a mean second height effective to impede passage of the vehicle when the supports are extended. When the supports are compressed, vehicles pass over the barrier unimpeded. When the supports are extended, the barrier impedes the motion of a vehicle travelling along the pathway. At least one deceleration cable mechanically couples the barrier to a brake system.

26 Claims, 8 Drawing Sheets

NON-LETHAL, RAPIDLY DEPLOYED, VEHICLE IMMOBILIZER SYSTEM

This is a division of application Ser. No. 08/672,148, now U.S. Pat. No. 5,829,912, that was filed on Jun. 27, 1996 and is incorporated herein by reference in its entirety.

BACKGROUND OF THE INVENTION

1. Field of the Invention

This invention relates to a device for impeding the motion of a land vehicle. More particularly, a barrier is rapidly deployed through the rapid extension of telescoping supports.

2. Description of the Prior Art

The military and police officials are at times required to stop a moving land vehicle. For example, the military may be called on to stop a truck laden with explosives. The police may be called on to stop a speeding car containing suspected criminals. It is desirable that the occupants of these vehicles, that may include hostages, not be injured by immobilization of the vehicle. Therefore, immobilization by conventional methods such as road blocks using other vehicles and tire puncturing is not acceptable.

Devices to stop a moving land vehicle without injury to the occupants are disclosed in U.S. Pat. Nos. 4,576,507 to Terio et al. and in U.S. Pat. No. 4,824,282 to Waldecker, both of which are incorporated by reference in their entireties herein.

The Terio et al. patent discloses a pair of I-beams disposed on opposing sides of a roadway supported in an underground enclosure. Cables supported by shock absorbers extend between the I-beams. When the barrier is actuated, the I-beams rise from the underground enclosure, extending the cables across the roadway.

The Waldecker patent discloses a plurality of fabric cylinders disposed in a trench extending across a roadway. A net is supported on one side of these cylinders. When actuated, gas generators fill the cylinders causing them to rise and form a barrier across the roadway. Impact with the gas-filled cylinders serves as a primary braking means to impede the land vehicle. The net forms a secondary braking means.

While the above vehicle immobilization systems are useful, they have the disadvantage of being complex, heavy and immobile. They are useful for protection of a fixed target, but are less useful for protecting temporary targets, such as an arena being visited by a head of state. They are also not useful for rapid deployment in a remote site, such as encountered by police seeking to stop the escape of criminals.

There exists, therefore, a need for a transportable, rapidly deployed, vehicle immobilization system that does not suffer from the disadvantages of the prior art.

SUMMARY OF THE INVENTION

Accordingly, it is an object of the invention to provide a vehicle immobilization system that is both transportable and rapidly deployed. It is a feature of this vehicle immobilization system that telescoping supports are rapidly extended by a propulsion unit. The telescoping supports may be either embedded in the ground or anchored above ground. A barrier extending between the telescoping supports permits free travel of land vehicles when the telescoping supports are compressed, but stops moving vehicles with a deceleration force of less than 2 g (twice the force of gravity) when the telescoping supports are extended.

Among the advantages of the vehicle immobilization system of the invention are that the system is both lightweight and transportable. The system is readily deployed as and where needed. A further advantage is that a moving land vehicle is not destructively immobilized facilitating the safe removal of the occupants.

In accordance with the invention, there is provided a transportable device for impeding the motion of a land vehicle that is travelling along a pathway. This device has first and second supports positioned at first and second sides of the pathway, respectively, each capable of being actuated from a compressed condition to an extended condition. A propulsion system is effective to actuate the supports. A barrier extends between the supports at a mean first height that is effective to permit passage of vehicles when the supports are compressed and held by each support at a mean second height effective to impede passage of a vehicle when the supports are extended. When the supports are compressed, vehicles pass over the barrier unimpeded. When the supports are extended, the barrier impedes the motion of a vehicle traveling along the pathway. At least one deceleration cable mechanically couples the barrier to a brake system.

In specific implementations of the invention, each support may have a housing, a first telescoping element, and a second telescoping element. The first telescoping element is moveable upward relative to the housing upon actuation of the associated support. The second element is concentric with the first element and moveable upward relative to the first element to reach an extended height upon actuation of the associated support. The barrier is supported by the second element of each support. The propulsion system may comprise a rapidly combusting chemical mix. The supports may be positioned so that their respective housings are atop and not substantially sunk into the ambient terrain so that majorities of the first and second telescoping elements are positioned above the terrain when the supports are in the compressed condition. The supports may each have a plurality of anchors effective to anchor the supports against force transmitted from the impact of the vehicle with the barrier. The anchors may be at least partially embedded in the terrain. The telescoping elements may be inner and outer intermeshed cylinders.

Prior to deployment, the barrier may be housed in a barrier enclosure. The barrier enclosure may have a top including first and second hinged cover elements. The cover elements may be moveable from a closed condition for storing the barrier beneath the top and protecting the barrier from vehicles passing over the enclosure to an open condition in which the barrier may be deployed upward through a gap between the cover elements.

In the closed condition, the cover elements may be separated by a convoluted separation line defining intermeshing inboard edges of the first and second cover elements. Such edges may be directed generally upward in the open condition and effective to puncture the tires of a vehicle passing over the enclosure. The enclosure may have a generally trapezoidal cross-section.

The deceleration cables may be configured to cross behind a vehicle which has collided with the barrier so as to extend along first and second sides of such vehicle and impede opening of the doors of such vehicle sufficiently to impede escape of occupants of the vehicle.

The above stated objects, features and advantages will become more apparent from the specification and drawings that follow.

IN THE DRAWINGS

FIGS. 7 through 11 schematically illustrate the operation of the vehicle immobilization device of the invention.

Figure 12:
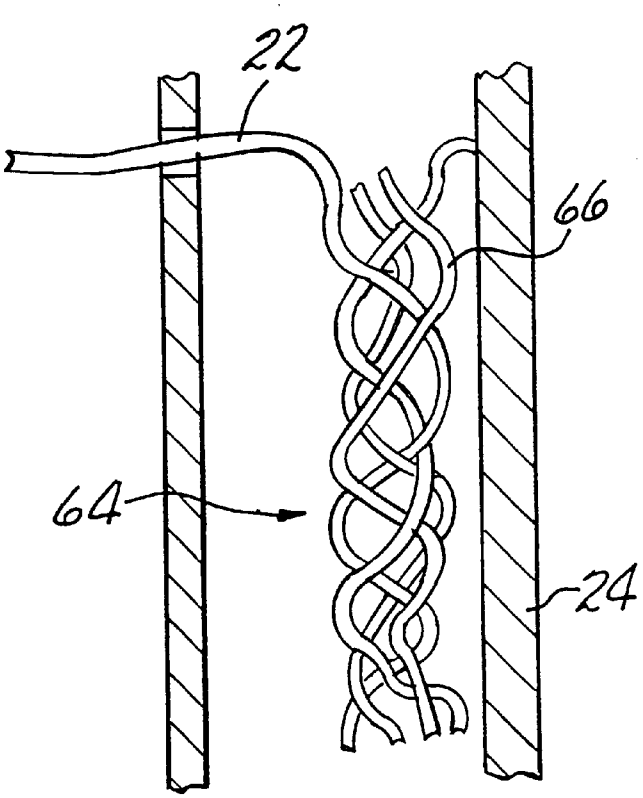

FIG. 12 schematically illustrates a braking system in accordance with an embodiment of the invention.

Figure 13:
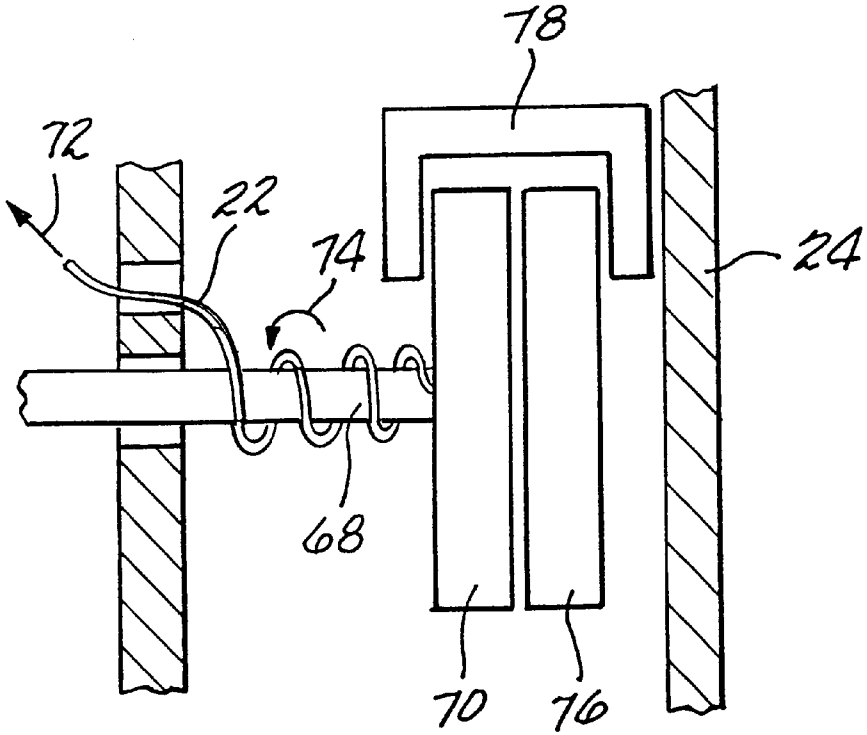

FIG. 13 schematically illustrates a braking system in accordance with a second embodiment of the invention.

DETAILED DESCRIPTION

Figure 1:
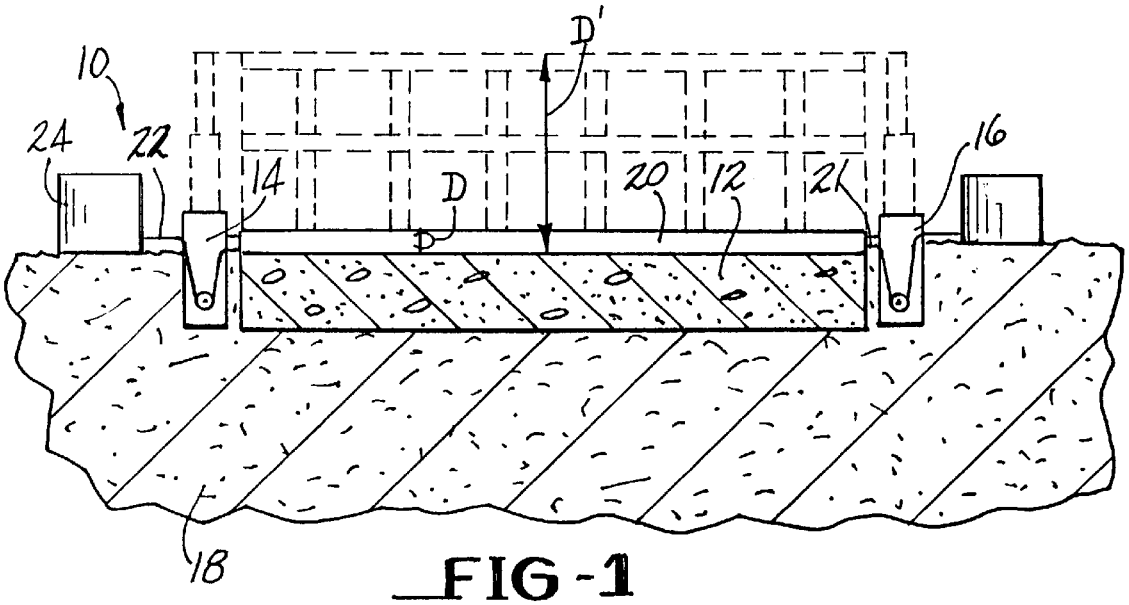
FIG. 1 illustrates in partial cross-section the vehicle immobilization device of the invention prior to deployment.

FIG. 1 illustrates, in partial cross-sectional representation, a transportable device 10 for impeding the motion of a vehicle that is travelling along a pathway 12. While the pathway 12 is illustrated as a paved road, the invention is equally applicable to other pathways such as unpaved roads, rails and narrow waterways, such as canals.

Figure 5:
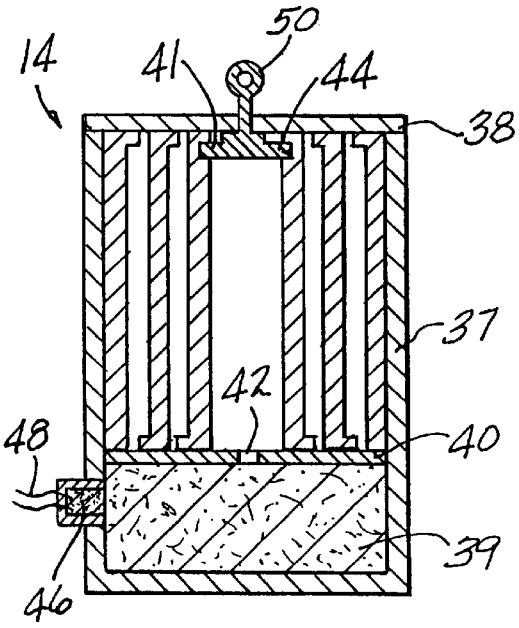
FIG. 5 illustrates in cross-sectional representation a telescoping support in accordance with the invention.
Figure 6:
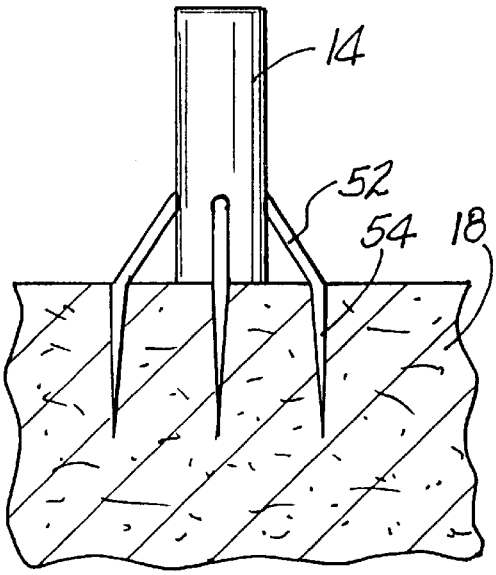
FIG. 6 illustrates in partial cross-section a mechanism for anchoring a telescoping support above ground.

The device 10 includes a first telescoping support 14 and a second telescoping support 16. The first telescoping support 14 and second telescoping support 16 are anchored to opposing sides of the pathway 12. Such anchoring may be by partial embedding in the ground 18 as illustrated in FIG. 1 or by explosively driven anchors as illustrated in FIG. 5.

The telescoping supports 14, 16 support a barrier 20 by a breakaway cord 21 or other detachable connection. When compressed, the telescoping supports 14, 16 extend the barrier 20 across the pathway 12 at a mean first height, D, that is typically between 0 inches (flush with the pathway) and 6 inches. Preferably, D is from 0 inches to 2 inches.

Preferably, both the first telescoping support 14 and the second telescoping support 16 are at the same height to support the barrier uniformly across the pathway 12. When extended by a suitable propulsion system, the first telescoping support 14 and second telescoping support 16 raise the barrier 20 to a height, D' (indicated as an alternate position in FIG. 1) above pathway 12.

The barrier 20 extends between the telescoping supports 14, 16. When the telescoping supports 14, 16 are compressed, the height of the barrier 20 above the pathway 12 is sufficiently low to permit passage of land vehicles, preferably, D is less than 2 inches. When the telescoping supports 14, 16 are extended, the barrier 20 is at a height effective to impede passage of vehicles. D' is dependent on the vehicle to be stopped, including the tire size and vehicle weight. Preferably, D' is at least equal to the diameter of the vehicle tires. For an all terrain vehicle or a truck, D' is more than 36 inches and preferably from about 48 inches to about 80 inches.

The device 10 further includes at least one deceleration cable 22 that mechanically couples the barrier 20 to a brake system 24. The deceleration cable is an extended length, high strength, flexible strand such as a rope, cable, chain or webbing that transfers momentum imparted by the land vehicle from the barrier 20 to the brake system 24. The deceleration cable 22 has a yield strength and an elongation capacity sufficient to avoid breaking when the barrier 20 engages a moving vehicle. Since the barrier 20 may be called on to stop a moving truck having a weight of several tons, the yield strength of the deceleration cable 22 should be sufficient to stop that vehicle. High strength nylon rope and steel cable are exemplary. A preferred material for the deceleration cable 22 is 2 inch wide webbing formed from nylon.

The momentum of the vehicle is dissipated by the brake 22 to non-destructively stop the land vehicle.

Figure 2:
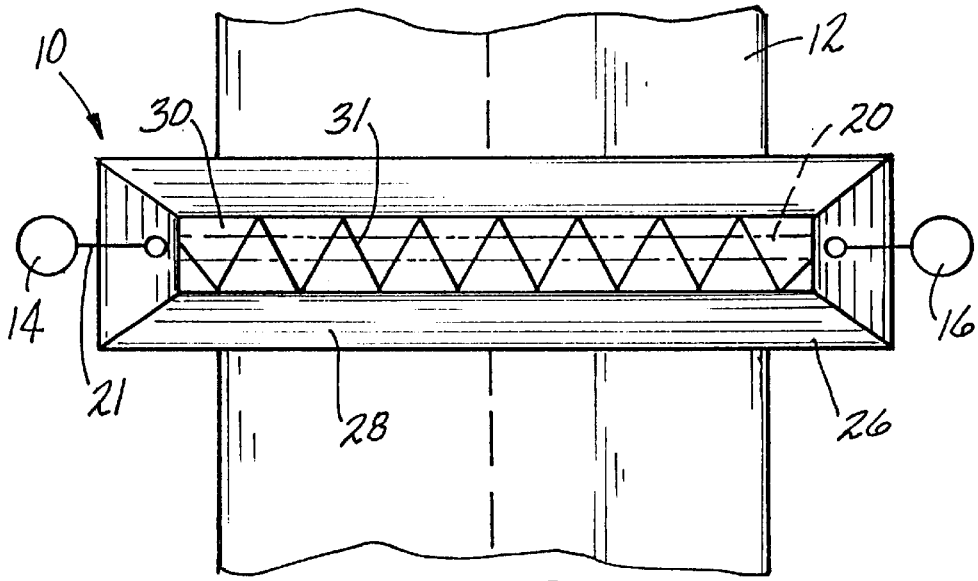
FIG. 2 illustrates in top isometric view a portion of the device of FIG. 1.

FIG. 2 illustrates in top isometric view, the device 10 prior to deployment. The telescoping supports 14, 16 are anchored to opposing sides of the pathway 12 and support the barrier 20 (shown in phantom). The barrier 20 is optionally housed within a barrier enclosure 26 that both protects the barrier from damage and facilitates the unimpeded passage of moving land vehicles.

The barrier enclosure 26 has the shape of a conventional speed bump, such as hemispherical or trapezoidal. The trapezoidal barrier enclosure 26 illustrated in FIG. 2 has gradually sloped surfaces 28 to guide a moving land vehicle over the barrier enclosure 26. Preferably, the barrier enclosure is a minimum height necessary to enclose the barrier 20. Typically, the barrier enclosure will extend from about 0 inch to about 6 inches above the pathway 12 and the surfaces 28 form an angle of between 0° and 15° with the pathway 12.

The barrier enclosure 26 is formed from any material having sufficient strength to withstand the passage of heavy land vehicles. Suitable materials include steel, aluminum and fiberglass. A top surface 30 is designed to avoid impeding deployment of the barrier 20. Preferably, the top surface 30 is hinged for accelerated opening. The top surface 30 may comprise two pieces separated by a jagged line 31. The jagged line forms pointed spikes or prongs on opening that are effective to pierce the tires of the vehicle.

Figure 3:
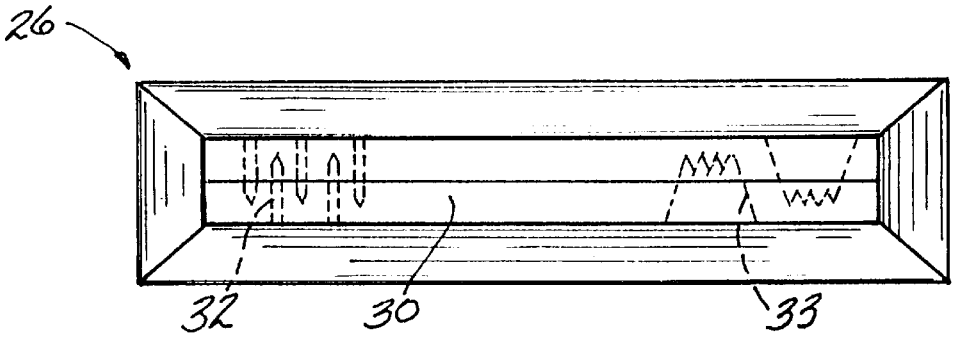
FIG. 3 illustrates mechanisms for piercing the tires of a vehicle.

FIG. 3 illustrates alternative mechanisms to pierce the tires of the vehicle to be stopped. The barrier enclosure 26 includes one or more piercing devices such as pointed spikes 32 or cutting blades 33 that are deployed when the top surface 30 opens.

Figure 4:
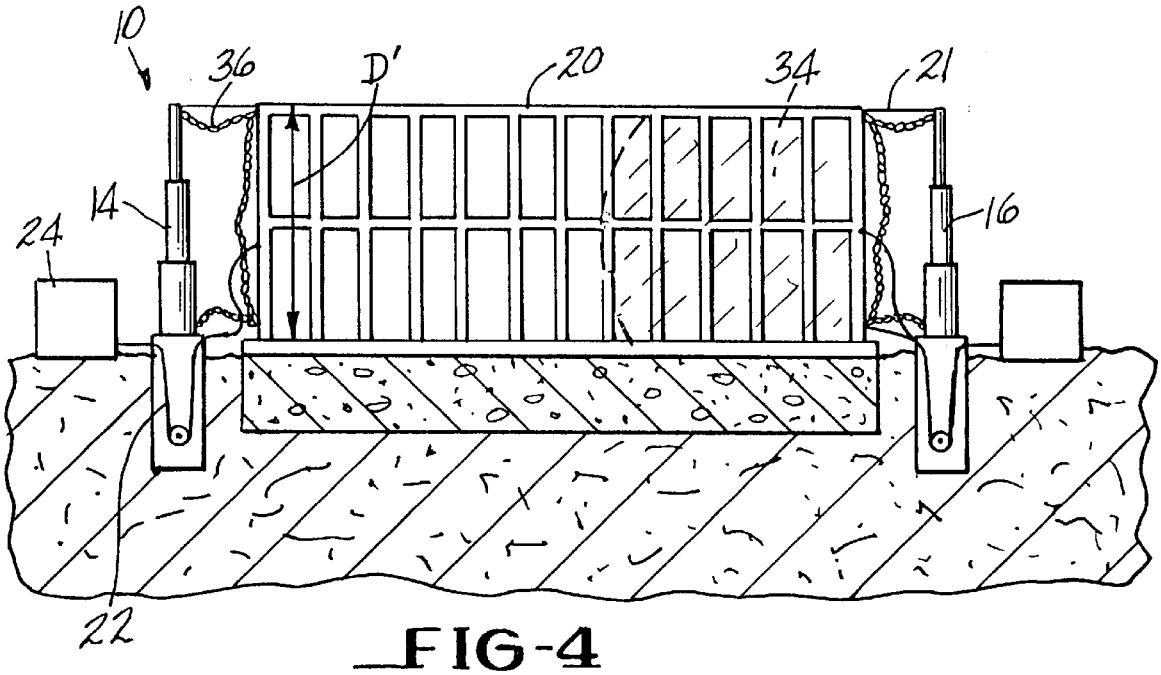
FIG. 4 illustrates in cross-sectional representation the device of FIG. 1 subsequent to deployment.

FIG. 4 illustrates the device 10 with telescoping supports 14, 16 deployed and the barrier 20 at the mean second height D' above the pathway 12. The barrier 20 at this height is effective to impede passage of a land vehicle.

The barrier 20 is any structure effective to stop the travel of a vehicle. Suitable structures for the barrier 20 include cables, webs and bands running either horizontally or vertically. In a preferred embodiment, the barrier 20 is a mesh or net having bands of sufficient strength to avoid breaking when engaging the moving vehicle. Suitable materials for the bands include high tenacity nylon and polyester. A suitable webbing has these bands with a width of from 1 inch to 4 inches and maximum openings of about 12 inches separating the bands.

The webbing forming the barrier 20 is preferably opaque or translucent, or supports an opaque or translucent film, such as a fabric. This obstructs the view of the occupants in the stopped vehicle increasing the safety of the personnel that deployed the vehicle stopping device.

In addition to the breakaway cord 21 and the deceleration cable 22, an elastic cord 36, such as a "bungee cord" is provided. The elastic cord is fastened near the top and bottom of the barrier to hold the webbing taut and open during deployment.

Deployment of the barrier 20 is by extension of the telescoping supports 14, 16. A compressed telescoping support 14 is illustrated in cross-sectional representation in FIG. 5. The support 14 is contained within an enclosure 37, typically manufactured from steel or aluminum, having a frangible or hinged cover 38. The housing 37 is a closed cylinder or other confined shape. A propulsion system 39 is contained adjacent to the closed end of the housing 37. A barrier 40 such as a thin strip of steel separates the propulsion system 39 from a support top plate 41. Activation of the propulsion system 39 communicates at propellant through an aperture 42 extending through barrier 40, driving the support top plate 41 upwards through the cover 38. The support top plate 41 engages the innermost of a plurality of intermeshed cylinders 44 that telescope outward to the second height, D'.

The propulsion system 39 is any suitable force generating composition such as compressed air or pressurized hydraulic fluid. Any gas generating chemical composition, such as a nitrocellulose/nitroglycerine based composition or an ammonium nitrate based composition may be employed.

Preferably, the propulsion system 39 is a rapidly combusting mix that is actuated by a conventional initiator 46. Rapidly combusting mixes are preferred over mechanically, hydraulically or pneumatically actuated systems because the rate of deployment of the telescoping supports is much quicker and the required volume of force generating composition is much less. The initiator 46 is actuated by an electrical signal from leads 48.

The electrical signal may be generated by any suitable signal source such as a manually operated button, a pressure activated sensor embedded in the pathway or a light beam extending across the pathway.

A control system may be used to detect the approaching vehicle and to determine speed and distance. Suitable devices to determine these parameters include pressure sensors embedded in the pathway, electo-optical sensing devices and electromagnetic radiation sensing devices. The control system erects the battier at the appropriate time, based on vehicle speed, to insure the vehicle can not pass over the device and that the driver has inadequate time to take evasive action to avoid the barrier.

The rapidly combusting mix, that is preferably an ammonium nitrate based propellant, when initiated generates a pressure effective to fully deploy the telescoping support 14 in less than 5 seconds. Preferably, the telescoping support 14 is fully deployed in under 1 second and most preferably in from 0.1 to 0.4 seconds.

For a telescoping support having an inside diameter of about 3 inches that extends from a compressed height of about 2 feet to an extended height of up to 8 feet, it is anticipated that about 100 grams of the ammonium nitrate based propellant is required.

The intermeshing cylinders 44 are formed from any material having sufficient strength to withstand forces imposed by a vehicle striking the barrier that is connected to the intermeshing cylinders, such as through connector 50. Suitable materials for the intermeshing cylinders include steel and aluminum.

The telescoping supports 14 are anchored to avoid dislocation when the barrier engages a moving vehicle. The telescoping supports may be embedded in the ground, as illustrated in FIG. 4 and, optionally, are supported by a cement block (not shown) if the vehicle immobilization device is to be permanently installed at a fixed location. If mobility is desired, then a telescoping support 14 as illustrated in FIG. 5 is employed. The telescoping support is anchored through tether lines 52 by explosively driven anchors 54, stakes driven into the ground, buried anchors or other suitable means. Generally, from about 2 to about 8 anchors are effective to prevent dislocation of the telescoping support 14 when the barrier is engaged with a moving land vehicle.

Figure 7:
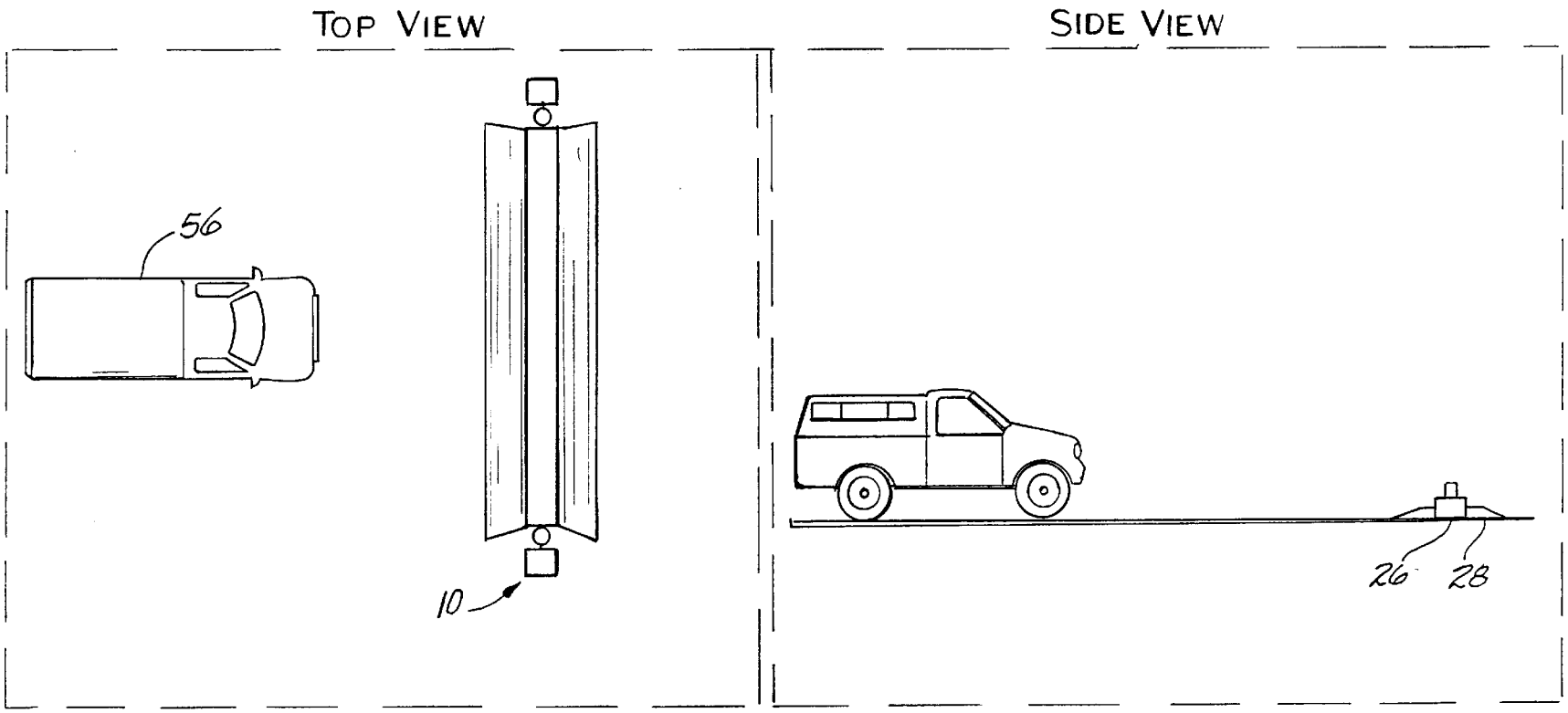

FIGS. 7 through 11 illustrate the operation of the vehicle immobilizer system of the invention. In FIG. 7, a vehicle 56 approaches the device 10 that is in the pre-deployment mode. The sloped surfaces 28 of the barrier enclosure 26 permit passage by non-threatening vehicles.

Figure 8:
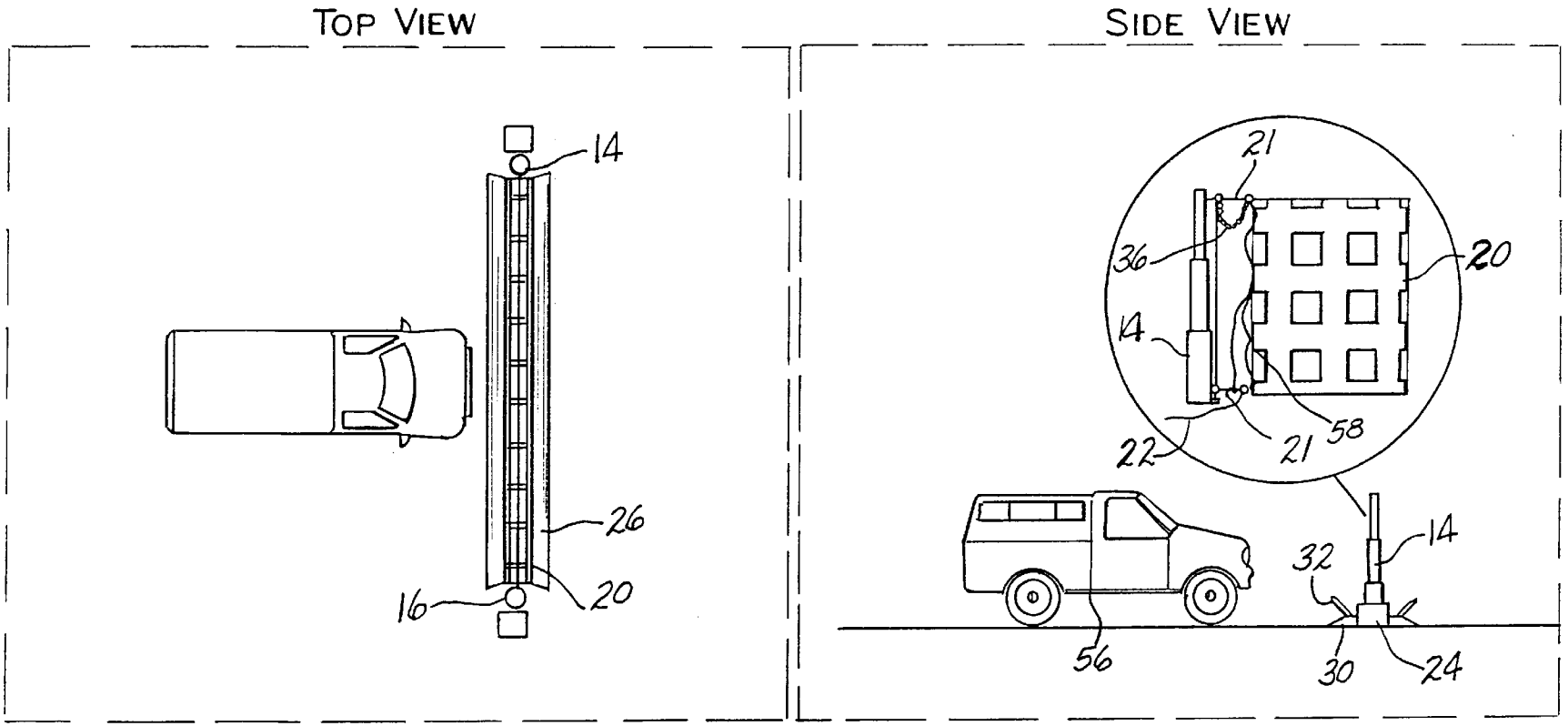

The approach of a hostile vehicle causes deployment of the barrier 20 as illustrated in FIG. 8. The top surface 30 of the barrier enclosure 26 opens and, optionally, presents tire piercing spikes 32 to the vehicle 56. The telescoping supports 14, 16 rise to the upright position deploying the barrier 20 to a height effective to stop the vehicle 56.

The insert to FIG. 8 shows the attachment of the barrier 20 to the telescoping support 14. Breakaway cords 21 initially fasten the barrier to the telescoping supports so that raising of the supports deploys the barrier. Optionally, elastic cords 38 are attached to the top and the bottom of the barrier 21.

A harness 58 is disposed between the top and bottom elastic cords. A deceleration cable 22 is attached to the barrier 20 through the harness 58 and couples the barrier to the brake system 24.

Figure 9:
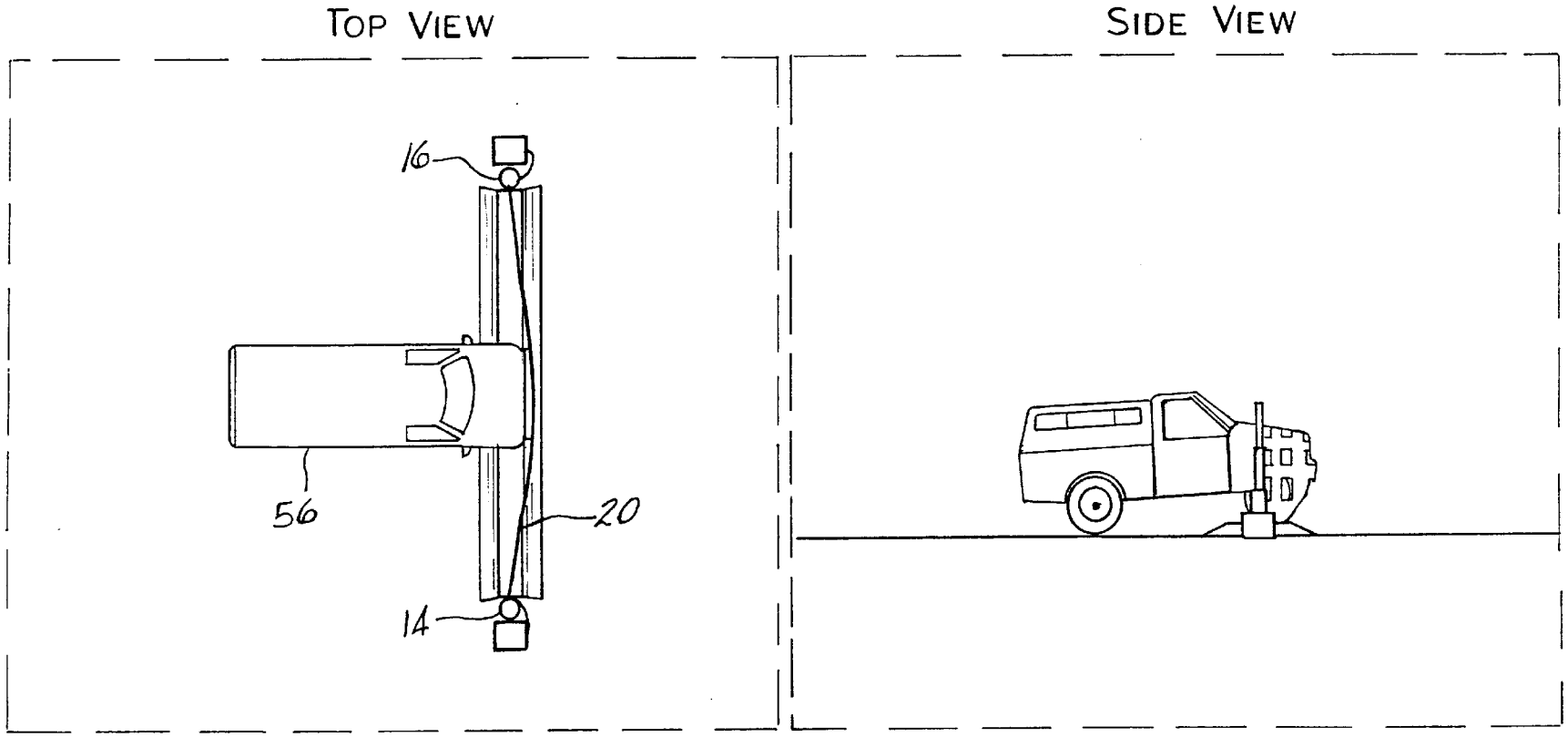

FIG. 9 illustrates the vehicle 56 impacting the barrier 20. The breakaway cords snap freeing the barrier 20 from the telescoping supports 14, 16. The barrier is held taut against the vehicle 56 by the elastic cord.

Figure 10:
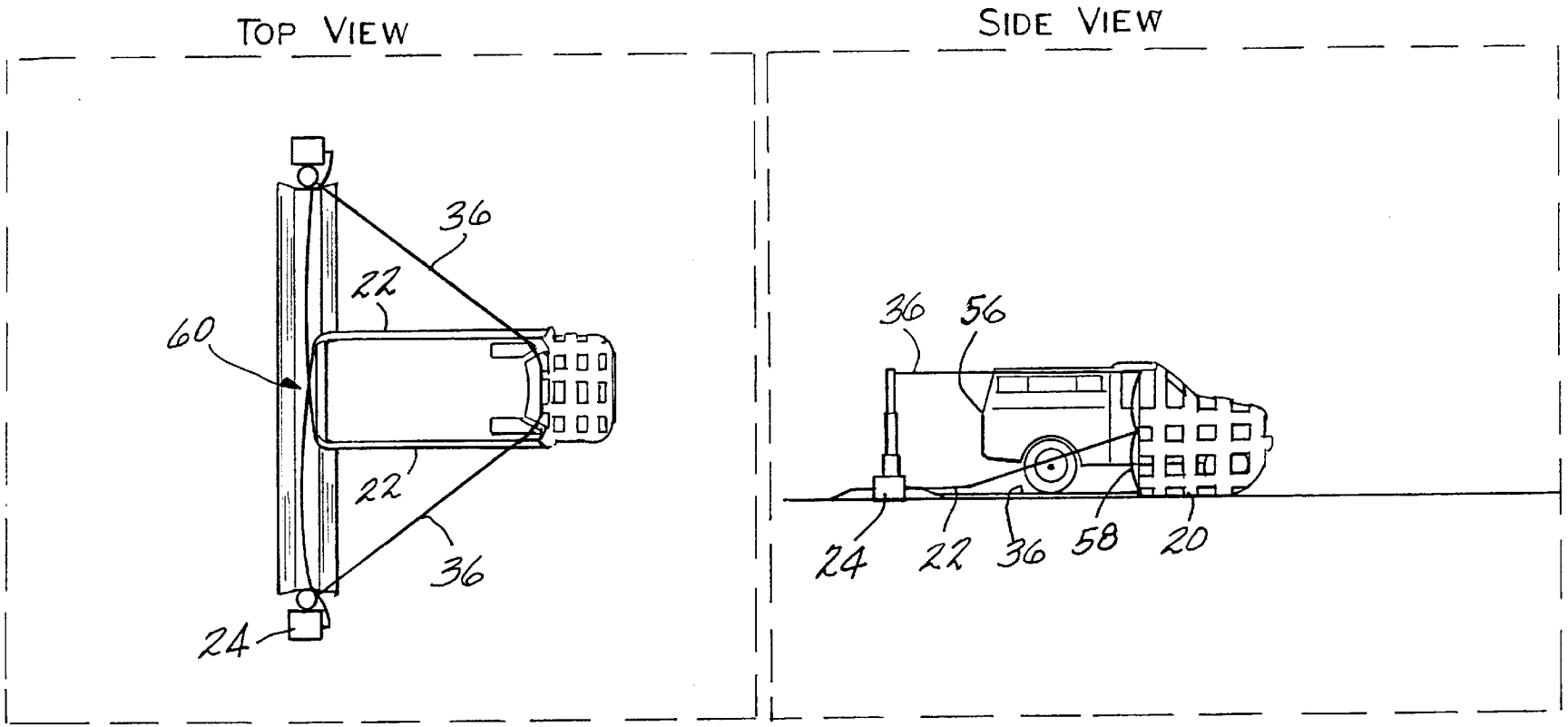

FIG. 10 illustrates the barrier 20 fully engaged against the front of the vehicle 56. Elastic cords 36 maintain the barrier against the vehicle. Deceleration cables 22, optionally supported by harness 58, is deployed from the brake system 24. The deceleration cables extend along the side of the vehicle 56 to prevent opening of the vehicle doors and the escape of the occupants. The deceleration cables preferably cross 60 at the rear of the vehicle to prevent escape by going in reverse.

Figure 11:
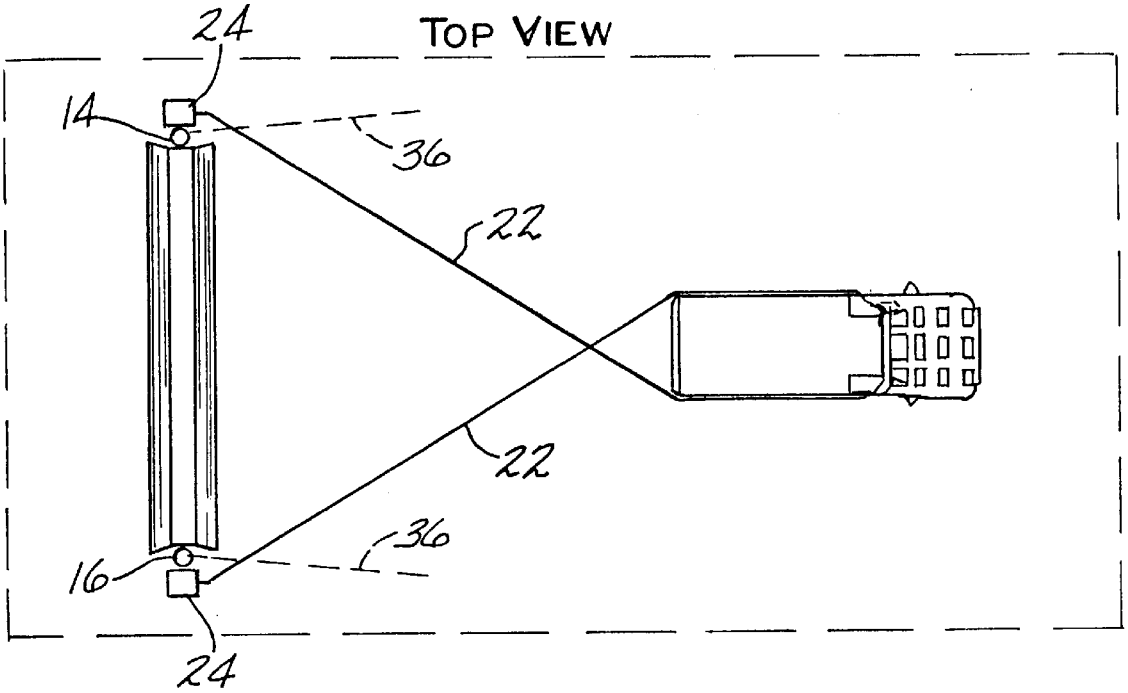
Figure 11:
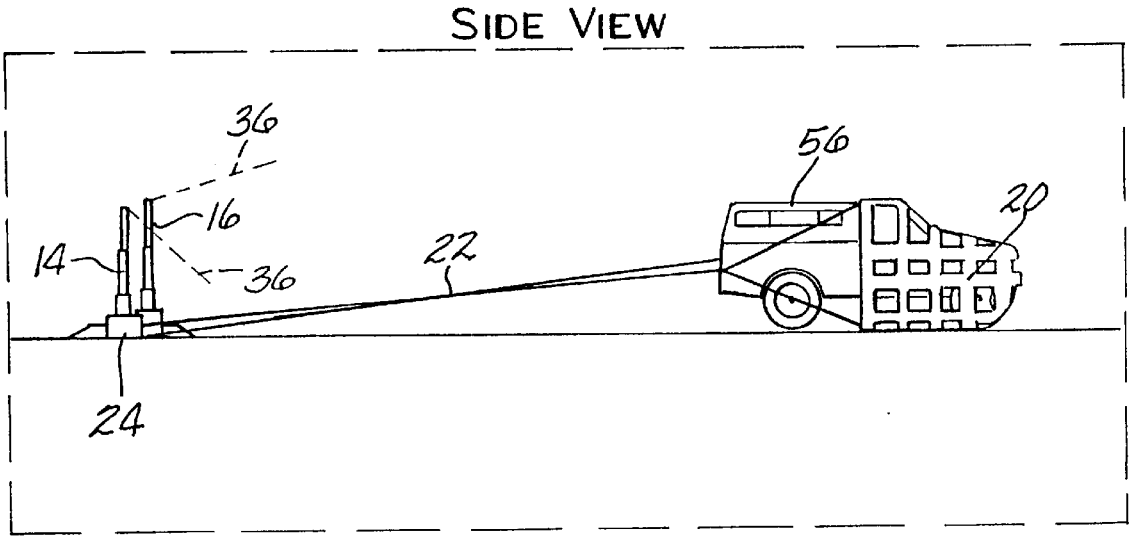

FIG. 11 illustrates the barrier 20 fully engaged against the vehicle 56, obstructing both the door and windshield of the vehicle. The elastic cords 36 have snapped engaging the deceleration cables 22 that are coupled to the braking system 24. The deceleration cables 22 pass through the telescoping supports 14, 16 to one or more brake systems 22. The brake systems absorb the force communicated to the barrier 20 by the vehicle 56 and gradually bring the vehicle to a stop.

The brake system 24 applies a constant rate of mechanical braking to the vehicle 56 at a relatively low deceleration rate, typically between 0.5 g and 3 g and preferably between 1 g and 2 g. "g" is defined as the acceleration of gravity at sea level on the earth.

To stop a vehicle travelling at 60 miles per hour (88 feet/second) with a constant deceleration of 1 g requires a distance of 120 feet. The deceleration cables combined with the braking system therefore have a sufficient length for a stopping distance of at least 60 feet, for 2 g deceleration, and preferably, the effective length is at least 120 feet.

Constant braking is achieved by any suitable means. FIG. 12 illustrates one embodiment where the deceleration cable 22 engages a ripcord 64 anchored to the brake system 24.

The ripcord 64 is a plurality of intertwined fibers 66 that require a constant force to unravel. A suitable ripcord is intertwined fibers of nylon or "KEVLAR" (trademark of DuPont, Wilmington, Del.) requiring a constant force of between about 2000 pounds and about 8000 pounds to unravel dependent on the vehicle to be stopped. It is anticipated that about 120, feet of ripcord 64 would be required to bring a vehicle travelling at 60 miles per hour to a stop within desired less than 2 g deceleration.

A second embodiment, illustrated in FIG. 13, is similar to a conventional automobile braking system. The deceleration cable 22 is wound around a shaft 68 of a first metal plate 70. Engagement of the deceleration cable by impact of the barrier by a vehicle (reference arrow 72) causes the shaft to rotate (reference arrow 74) rotating the first metal plate 70. The first metal plate 70 engages a friction plate 76. Friction between the first metal plate 70 and the friction plate 76 provide the braking action. Hydraulic, electric, water brakes and torque converters are also suitable braking systems.

A governor 78 determines the rate of deceleration by varying the friction between the first metal plate 70 and the friction plate 76. Preferably, the deceleration rate does not exceed about 2 g. The friction required to safely decelerate a moped is much less than that required to stop a fully loaded truck.

While telescoping supports are described herein, other rapidly extending structures such as pistons and tractor rockets may also be used. The selection of the support structure is dependent on both the intended application and the size of the vehicle to be immobilized.

While the barrier enclosure is described as a speed bump extending above the surface of a pathway, it is within the scope of the invention for the barrier enclosure to be embedded either in the pathway surface or underground below the pathway surface.

While the barrier and the brake system are illustrated as aligned, they may also be offset.

The entire vehicle immobilization system is transportable in a pick-up truck or similar vehicle. It is believed the entire system could be easily installed and removed by a two person crew.

It is apparent that there has been provided in accordance with this invention a transportable device for immobilizing a land vehicle that fully satisfies the objects, features and advantages set forth hereinabove. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A transportable device for impeding the motion of a target vehicle travelling along a pathway on a terrain surface, comprising:

first and second support members, each capable of being actuated from a compressed condition to an extended condition, and each comprising:

a housing;

a first telescoping element moveable upward relative to the housing upon actuation of the associated support member from said compressed condition to said extended condition; and a second telescoping element concentric with the first telescoping element and moveable upward relative to the first telescoping element to reach an extended height upon actuation of the associated support member from said compressed condition to said extended condition;

a propulsion system effective to actuate said first and second support members from said compressed condition to said extended condition;

a flexible barrier extending between said first and second support members at a mean first height that is effective to permit passage of vehicles when said first and second support members are in said compressed condition and supported by the second telescoping elements of the first and second support members at a mean second height effective to impede passage of said target vehicle when said first and second support members are in said extended condition;

a brake system; and at least one deceleration cable mechanically coupling said barrier to said brake system.

2. The device of claim 1 wherein said propulsion system comprises a rapidly combusting chemical mix.

3. The device of claim 1 wherein said first and second support members are positioned so that their respective housings are atop and not substantially sunk into the ambient terrain so that majorities of the first and second telescoping elements are positioned above the ambient terrain when the first and second support members are in the compressed condition.

4. The device of claim 1 wherein said first and second support members each comprise a plurality of anchors effective to anchor the associated first and second support members against force transmitted from impact of the vehicle with the barrier.

5. The device of claim 4 wherein the plurality of anchors are at least partially embedded in the ambient terrain.

6. The device of claim 1 wherein said first and second telescoping elements of each of said first and second support members are respective outer and inner intermeshed cylinders.

7. The device of claim 1 wherein said extended mean second height is higher than a diameter of a tire of the vehicle to be stopped.

8. The device of claim 1 wherein said brake is effective to provide said vehicle with a maximum deceleration rate of between 0.5 g and 3.0 g.

9. The device of claim 1 wherein said brake is effective to provide said vehicle with a maximum deceleration rate of between 1.0 g and 2.0 g.

10. The device of claim 1 wherein said barrier is housed, prior to deployment, in a barrier enclosure having a top comprising first and second hinged cover elements moveable from:

a closed condition for storing the barrier beneath the top and protecting the barrier from vehicles passing over the barrier enclosure, in which closed condition the first and second cover elements are separated by a convoluted separation line defining intermeshing inboard edges of the first and second cover elements, to:

an open condition in which the barrier may be deployed upward through a gap between the first and second cover elements, the inboard edges being directed generally upward and effective to puncture the tires of a vehicle passing over the enclosure.

11. The device of claim 10 wherein said barrier enclosure has a generally trapezoidal cross-section.

12. The device of claim 1 comprising first and second such deceleration cables configured to cross behind a vehicle which has collided with the barrier so as to extend along first and second sides of the vehicle and so as to impede opening of doors of such vehicle sufficiently to impede escape of occupants of the vehicle.

13. The device of claim 1 wherein said first and second support members each further comprise:

a third telescoping element, concentric with the first telescoping element and moveable upward relative to the first telescoping element upon actuation of the associated support member from said compressed condition to said extended condition; and wherein the second telescoping element is moveable upward relative to the third telescoping element to reach said extended height upon actuation of the associated support member from said compressed condition to said extended condition.

14. The device of claim 1 wherein said barrier is housed, prior to deployment, in a barrier enclosure, placeable atop the pathway and having an upper surface configured to protect the barrier from vehicles passing over the barrier enclosure.

15. A method for impeding the motion of a target vehicle travelling along a pathway on a terrain surface, the pathway initially lacking dedicated features for engaging a barrier, the method comprising:

selecting a barrier site along the pathway;

positioning a barrier enclosure across and atop the pathway at the barrier site, the barrier enclosure having a top with:

a closed condition wherein the enclosure contains a barrier in an undeployed condition in which undeployed condition a central portion of the barrier within the enclosure is above the pathway and wherein the top is configured to allow passage of vehicles over the enclosure without damage to such undeployed barrier; and an open condition wherein the barrier may be deployed upward from the barrier enclosure to block the target vehicle;

positioning first and second support members on first and second sides of the barrier enclosure, respectively, each capable of being actuated from a first condition to a second condition, the barrier supported by the first and second support members at a height effective to impede passage of said target vehicle when said first and second support members are in said second condition;

detecting the approach of a target vehicle to the barrier site; and actuating said first and second support members from said first condition to said second condition, responsive to such detection, so as to raise the barrier from said undeployed condition to a deployed condition to deploy the barrier to impede passage of the target vehicle.

16. The method of claim 15, wherein said first condition is compressed condition and said second condition is an extended condition wherein each of the first and second support members comprises:

a housing;

a first telescoping element, moveable upward relative to the housing upon actuation of the associated support member from said compressed condition to said extended condition; and a second telescoping element, concentric with the first telescoping element and moveable upward relative to the first telescoping element to reach an extended height upon actuation of the associated support member from said compressed condition to said extended condition, the barrier supported by the second telescoping elements of said first and second support members at said height effective to impede passage of said target vehicle when said first and second support members are in said extended condition.

17. The method of claim 16, wherein the positioning said first and second support members comprises:

placing the first and second support members atop the ambient terrain; and anchoring the first and second support members to the ambient terrain.

18. The method of claim 16, wherein the actuating said first and second support members comprises combusting a chemical mixture.

19. The method of claim 16 wherein engagement of the target vehicle and the barrier causes first and second deceleration cables to cross behind the target vehicle so as to extend along first and second sides of the target vehicle and so as to impede opening of doors of such target vehicle sufficiently to impede escape of occupants of the target vehicle.

20. The method of claim 16, wherein the actuating said first and second support members comprises subjecting the first and second telescoping elements of the first and second support members to compressed air.

21. The method of claim 15, further comprising:

allowing at least one non-target vehicle to pass over the barrier enclosure in the closed position.

22. A device for impeding the motion of a target vehicle target travelling along a pathway, comprising:

first and second support members, each capable of being actuated from a compressed condition to an extended condition;

a propulsion system effective to actuate said first and second support members from said compressed condition to said extended condition;

a flexible barrier extending between but substantially not supported by said first and second support members at a mean first height that is effective to permit passage of vehicles when said first and second support members are in said compressed condition and supported by the first and second support members at a mean second height effective to impede passage of said target vehicle when said first and second support members are in said extended condition, the first and second support members being the only such support members and being positioned so that the target vehicle may pass between the first and second support members in said extended condition while engaging the barrier; a brake system; and at least one deceleration cable mechanically coupling said barrier to said brake system.

23. The device of claim 22 being transportable.

24. The device of claim 22 wherein said barrier is housed, prior to deployment, in a barrier enclosure, placeable atop the pathway and having an upper surface configured to protect the barrier from vehicles passing over the barrier enclosure.

25. A method for impeding the motion of a target vehicle travelling along a pathway on a terrain surface, the pathway initially lacking dedicated features for engaging a barrier, the method comprising:

selecting a barrier site along the pathway;

positioning a barrier enclosure across and atop the pathway at the barrier site, the barrier enclosure having a top with:

a closed condition wherein the enclosure contains a barrier in an undeployed condition in which undeployed condition a central portion of the barrier within the enclosure is above the pathway and wherein the top is configured to allow passage of vehicles over the enclosure without damage to such undeployed barrier; and an open condition wherein the barrier may be deployed upward from the barrier enclosure to block the target vehicle;

positioning first and second support members at first and second positions, respectively, each capable of being actuated from a first condition to a second condition, the barrier supported by the first and second support members at a height effective to impede passage of said target vehicle when said first and second support members are in said second condition, the first and second positions allowing said target vehicle to pass between the first and second support members in said second condition;

detecting the approach of a target vehicle to the barrier site; and actuating said first and second support members from said first condition to said second condition, responsive to such detection, so as to raise the barrier from said undeployed condition to a deployed condition to deploy the barrier to impede passage of the target vehicle.

26. A device for impeding the motion of a target vehicle target travelling along a pathway on a terrain surface, comprising:

first and second support members, each capable of being actuated from a first condition to a second condition;

a propulsion system effective to actuate said first and second support members from said first condition to said second condition;

a flexible barrier extending between said first and second support members at a mean first height that is effective to permit passage of vehicles when said first and second support members are in said first condition and supported by the first and second support members at a mean second height effective to impede passage of said target vehicle when said first and second support members are in said second condition;

a brake system; and first and second deceleration cables mechanically coupling said barrier to said brake system and configured to cross behind a vehicle which has collided with the barrier so as to extend along first and second sides of the vehicle and so as to impede opening of doors of such vehicle sufficiently to impede escape of occupants of the vehicle.

* * * * *